US005441182A

United States Patent [19]

Sullivan

[11] Patent Number: 5,441,182

[45] Date of Patent: Aug. 15, 1995

[54] GARMENT HANGER WITH LOCKING INFORAMTION CLIP

[75] Inventor: Scott L. Sullivan, Chappaqua, N.Y.

[73] Assignee: Uniplast Industries, Inc., Hasbrouck Heights, N.J.

[21] Appl. No.: 138,706

[22] Filed: Oct. 18, 1993

Related U.S. Application Data

[63] Continuation-in-part of Ser. No. 109,129, Aug. 19, 1993, abandoned.

[51] Int. Cl.[6] ..... A47G 25/14

[52] U.S. Cl. ..... 223/85; 40/322; 40/666

[58] Field of Search ..... 223/85, 86, 92, 95; D6/315; 40/322, 666; 24/625, 555

[56] References Cited

U.S. PATENT DOCUMENTS

| | | | |
|---|---|---|---|
| D. 192,845 | 5/1962 | Cohen | D1/3 |
| D. 229,810 | 1/1974 | Wahl | D6/252 |
| D. 235,639 | 7/1975 | Cohen | D20/99 |
| D. 244,197 | 5/1977 | Ostroll | D19/13 |
| D. 245,748 | 9/1977 | Ostroll | D6/252 |
| D. 249,619 | 9/1978 | Wolff | D6/247 |
| D. 264,912 | 6/1982 | Bliss et al. | D6/254 |
| D. 282,982 | 3/1986 | Kodet | D6/328 |
| 970,529 | 9/1910 | Miller . | |
| 1,099,261 | 6/1914 | Lewyt . | |
| 1,142,720 | 6/1915 | McAuley . | |
| 1,321,926 | 11/1919 | Landry . | |
| 1,348,952 | 8/1920 | Landry . | |
| 1,389,266 | 8/1921 | Newton . | |
| 1,710,296 | 4/1929 | Clark . | |
| 1,738,724 | 12/1929 | Perleth et al. . | |
| 2,166,492 | 7/1939 | Harvey | 223/94 |
| 2,690,863 | 10/1954 | Adelman | 223/92 |
| 2,801,036 | 7/1957 | Klein | 223/92 |
| 3,024,953 | 3/1962 | O'Keefe | 223/88 |
| 3,535,808 | 10/1970 | Morrish | 40/322 |
| 3,898,754 | 8/1975 | Johansson | 40/322 |
| 3,949,914 | 4/1976 | Ostroll | 223/85 |
| 4,006,547 | 2/1977 | Samuels et al. | 40/322 |
| 4,017,990 | 4/1977 | Garrison | 40/322 |
| 4,045,899 | 9/1977 | Richardson | 40/322 |
| 4,101,059 | 7/1978 | Batts et al. | 223/85 |
| 4,115,940 | 9/1978 | Phillips | 40/322 |
| 4,123,864 | 11/1978 | Batts et al. | 40/322 |
| 4,137,661 | 2/1979 | Johansson | 40/322 |
| 4,160,333 | 7/1979 | Indelicato | 40/322 |
| 4,198,773 | 4/1980 | Batts et al. | 40/322 |
| 4,322,902 | 4/1982 | Lenthall | 40/322 |
| 4,333,590 | 6/1982 | Princiotta | 40/322 |
| 4,679,340 | 7/1987 | Johansson | 40/322 |
| 4,756,104 | 7/1988 | Bailey | 40/322 |
| 4,982,519 | 1/1991 | Hans | 40/666 |
| 4,997,114 | 3/1991 | Petrou | 223/85 |
| 5,096,101 | 3/1992 | Norman et al. | 223/85 |

FOREIGN PATENT DOCUMENTS

| | | |
|---|---|---|
| 130427 | 10/1968 | France . |
| 937188 | 9/1963 | United Kingdom . |
| 2010774A | 7/1979 | United Kingdom . |

*Primary Examiner*—Andrew M. Falik
*Assistant Examiner*—Bibhu Mohanty
*Attorney, Agent, or Firm*—Darby & Darby

[57] ABSTRACT

A garment hanger for use with a channel-shaped information clip, the hanger having a clip holder portion with an engagement element for preventing outward movement of the clip side wall after the clip is mounted on the clip holder portion, to prevent disengagement of the clip from the hanger. The clip has an outwardly projecting hook-like portion to engage the hanger engagement element.

18 Claims, 6 Drawing Sheets

FIG. 1
PRIOR ART
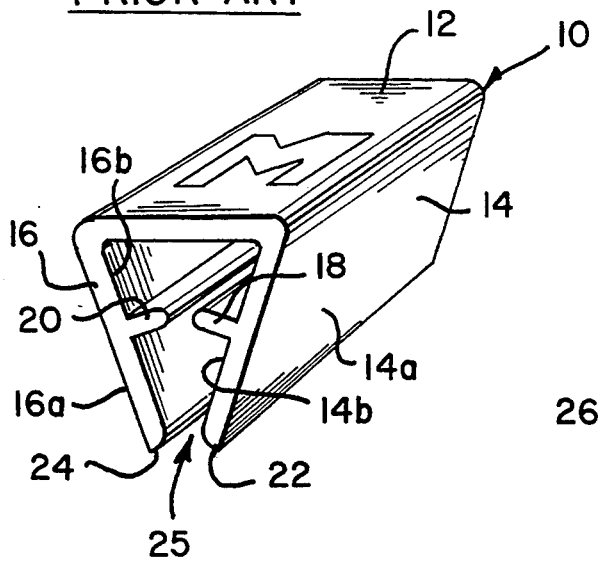
FIG. 2
PRIOR ART
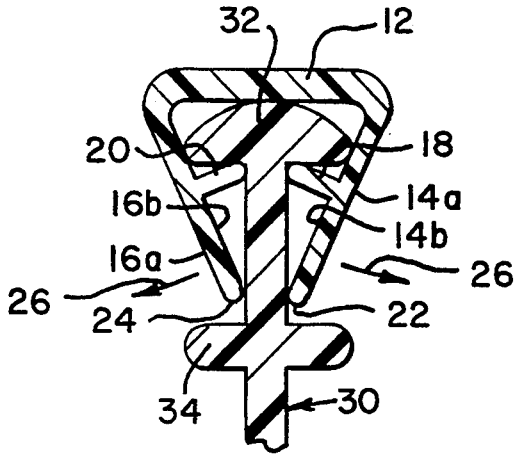
FIG. 3
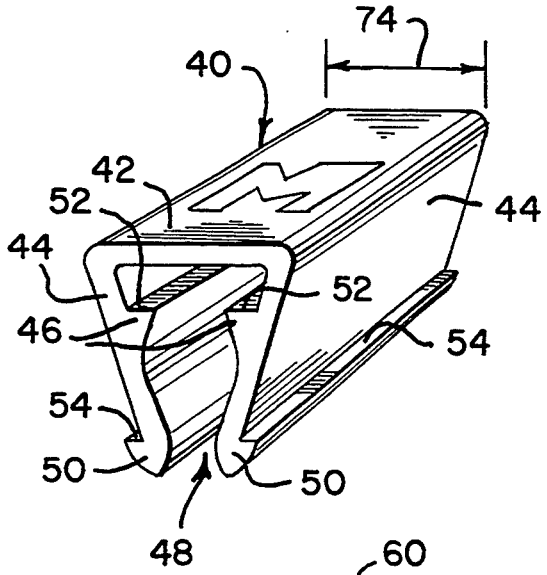
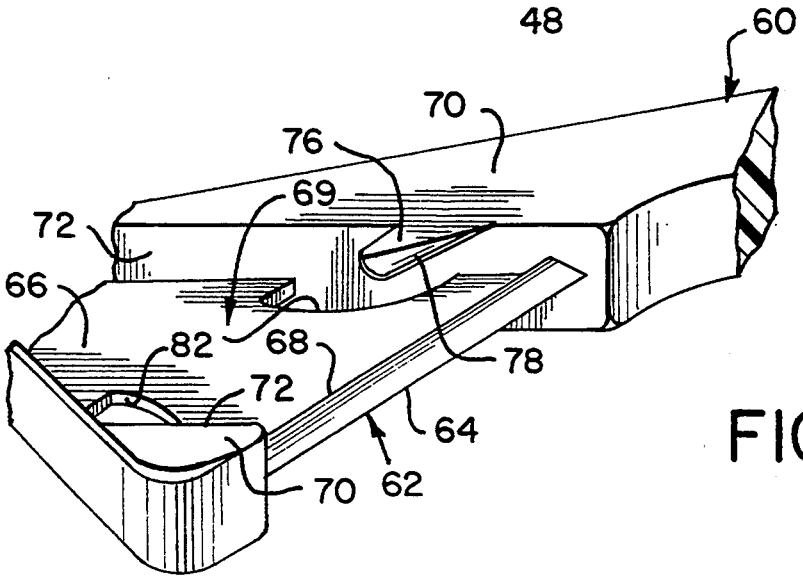
FIG. 4

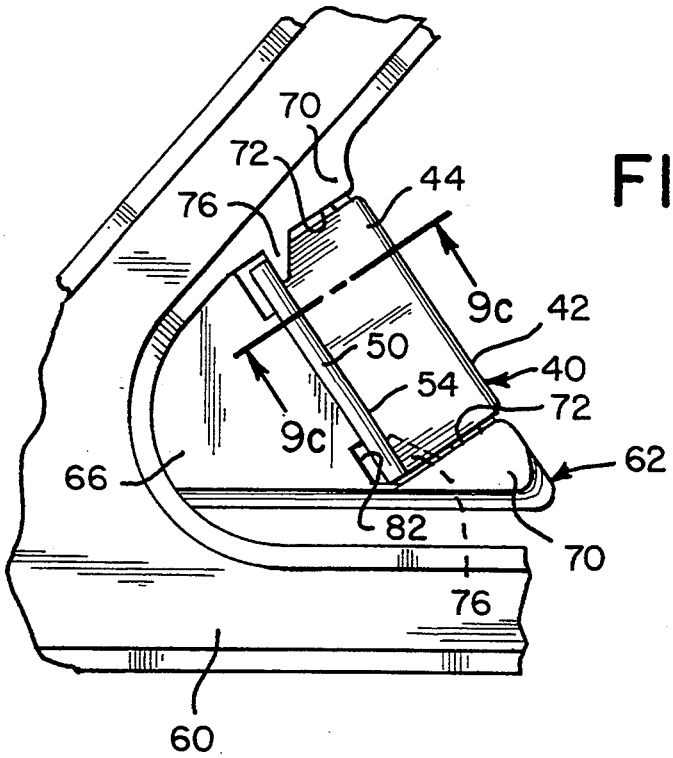
FIG. 8
FIG 9a
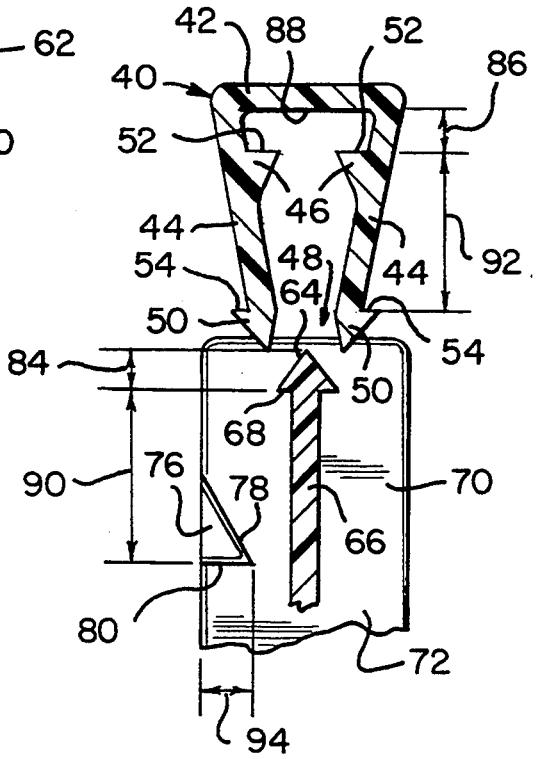
FIG. 9b
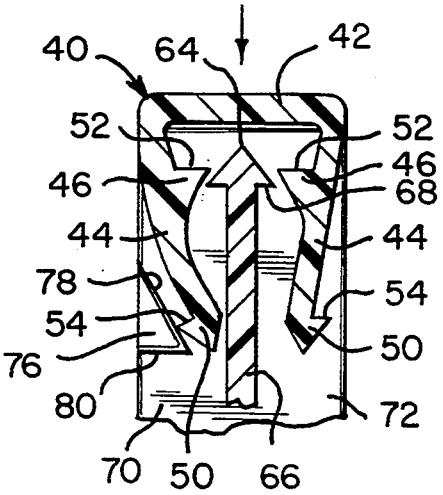
FIG. 9c
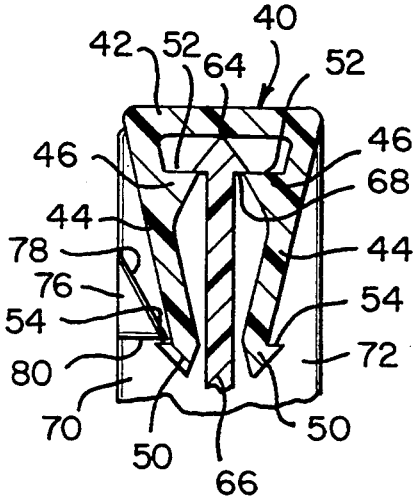

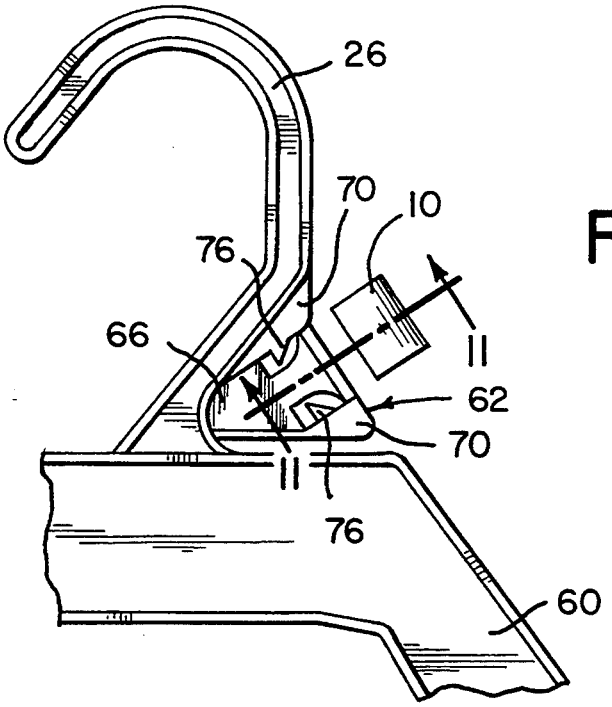
FIG. 10
FIG. 11
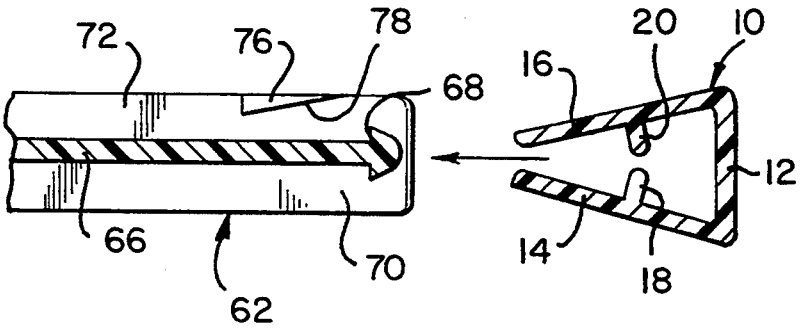
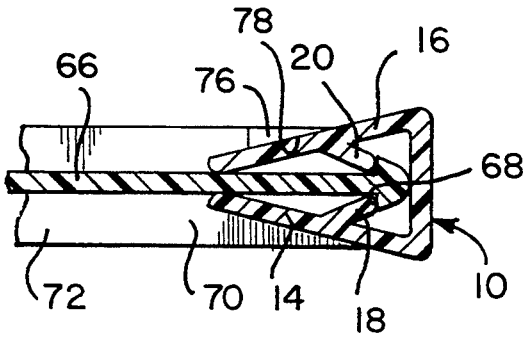
FIG. 12

GARMENT HANGER WITH LOCKING INFORAMTION CLIP

This is a continuation-in-part patent application of U.S. patent application Ser. No. 08/109,129, filed Aug. 19, 1993, now abandoned.

FIELD OF THE INVENTION

This invention is directed generally to a garment hanger of the type which includes locking information clips and, in particular, to both a garment hanger adapted to receive such a locking information clip so that its removal is prevented, and the locking information clip itself.

BACKGROUND OF THE INVENTION

Garment hangers having information clips have been previously known and used. U.S. Pat. No. 4,115,940, for example, discloses a molded plastic garment hanger which includes a web-like clip-mounting member which exposes a single edge onto which an information clip may be secured. The information clip of the hanger disclosed in U.S. Pat. No. 4,115,940 is intended to be easily removable and therefore the hanger offers no element or feature to prevent or discourage information clip removal. Other disclosures of information clips for garment hangers include U.S. Pat. No. 3,949,914 issued Apr. 13, 1976; U.S. Pat. No. 244,197 issued May 3, 1977; and U.S. Pat. No. 4,997,114 issued Mar. 5, 1991.

Such easily removable information clips are quite satisfactory for appropriate applications. However, in view of the small size of such clips, which may be readily swallowed, and with increased concerns about child safety, especially when such garment hangers are taken home with the purchased garment, it becomes important to provide a garment hanger which prevents the accidental removal of secured information clips. Also, where such clips may provide price information, it is desirable to prevent even intentional removal, to minimize possible fraudulent interchange of clips.

U.S. Pat. Nos. 5,096,101 and 5,199,608 both disclose garment hangers having lockable information clips. The garment hangers disclosed in these two patents include elements which discourage, but do not prevent, removal of a secured information clip. Referring to FIGS. 1 and 2 of the present drawings (labeled "prior art"), a commercially available and commonly used U-shaped information clip 10 is shown having a front surface 12, integrally formed side walls 14 and 16, and corresponding locking fingers, respectively, 18 and 20. Each side wall 14, 16 defines a lower edge 22, 24, outer surfaces 14*a*, 16*a* and inner surfaces 14*b*, 16*b*, respectively. The locking fingers 18, 20 are located along the inner surface 14*b*, 16*b*, respectively, and run the length of the information clip 10. An insertion channel 25 is defined by the two side walls 14, 16, between the lower edges thereof 22, 24.

These prior art information clips 10 are usually manufactured by an extrusion process using a resilient plastic such as PVC or Nylon. The resulting extruded information clip stock is then cut to a desired length (between ¾ and 1 inch) for each clip. Any information indicia, such as the size of a particular garment, may be printed on the front surface 12 and/or the outer surfaces 14*a*, 16*a* of the sidewalls 14, 16, using any conventional lettering transfer or printing technique.

Referring to FIG. 2 (labeled "prior art"), a prior art clip holder 30 is shown in cross-section with a secured prior art information clip 10. The prior art clip holder 30 includes a securing ridge 32 and a concealing ridge 34. The prior art information clip 10 is held to the prior art clip holder 30 by the engagement of each of the inwardly directed locking fingers 18, 20 (of each inner surface 14*b*, 16*b*) with a respective shoulder on the securing ridge 32. The side walls 14, 16 are resilient when they are displaced from a relaxed position. The material used and the shape of the information clip 10 allows the side walls to be displaced from each other, against the inherent resiliency of the clip 10.

As the prior art information clip 10 is pushed onto the securing ridge 32 and the insertion channel 25 advances along the prior art clip holder 30, the locking fingers 18, 20 will first contact the securing ridge 32. Further advance of the information clip 10 forces the two side walls 14, 16 apart, sufficiently to allow the locking fingers 18, 20 to clear the securing ridge 32. Once clear, the locking fingers 18, 20 will engage the shoulder on the inner edge of the securing ridge 32 and the side walls 14, 16 will move back to their relaxed position (as shown in FIGS. 1 and 2 (Prior Art)). This natural resiliency of the information clip 10 ensures tight engagement with the securing ridge 32.

The information clip 10 may be removed from the securing ridge 32 by pulling the side walls 14, 16 apart with respect to each other, (as illustrated by the arrows 26 in FIG. 2 (prior art)), against the inherent resiliency urging them to the relaxed position, sufficiently for each respective locking finger 18, 20 to clear a respective portion of the securing ridge 32. This prior art structure discourages, but does not prevent the removal of the information clip 10 by somewhat inhibiting access to the lower edges 22, 24 of the side walls 14, 16, by the concealing ridges 34. In doing so, it becomes only difficult, yet not at all impossible, to pull either side wall 14, 16 sufficiently apart to remove the information clip 10 from the clip holder 30 of the prior art.

Accordingly, it is an object of the invention to provide a garment hanger adapted to receive an information clip and both discourage and prevent its accidental and/or intentional removal from the hanger.

SUMMARY OF THE INVENTION

According to the present invention the information clip not only resiliently engages a ledge adjacent the edge of the clip holder, but in addition is provided with means to prevent moving the clip side walls apart to disengage the clip from the ledge. Further assurance of non-removability is provided by engaging hook-like edges of the clip with engagement elements in the clip holder, without interfering with use of ordinary injection molding for producing the hanger.

BRIEF DESCRIPTION OF THE DRAWINGS

FIG. 1 is a perspective view of a prior art information clip;

FIG. 2 is a side view of the prior art information clip attached to a prior art clip holder;

FIG. 3 is a perspective view of an information clip in accordance with the present invention;

FIG. 4 is a perspective fragmentary view of a garment hanger showing details of a new clip holder in accordance with the invention with no information clip mounted thereon;

FIG. 8 is a partial plan view of a garment hanger showing details of the new clip holder of FIG. 4 securely holding the new information clip of FIG. 3;

FIG. 9*a* is an illustrative transverse sectional view of the clip holder of FIG. 4 and the information clip of FIG. 3 shown in a pre-mounting position;

FIG. 9*b* is an illustrative transverse sectional view of the clip holder of FIG. 4 with the information clip of FIG. 3 mounted to the clip holder, but not yet securely locked;

FIG. 9*c* is a transverse sectional side view of the clip holder of FIG. 4 and the information clip of FIG. 3 in accordance with the invention, taken along the line 9*c*—9*c* of FIG. 8;

FIG. 10 is a partial plan exploded view of a garment hanger having a new clip holder in accordance with the invention and a PRIOR ART information clip;

FIG. 11 is a sectional view of the new clip holder in accordance with the invention usable with a prior art information clip, taken along the line 11—11 of FIG. 10, showing the prior art information clip prior to securement to the clip holder;

FIG. 12 is a transverse sectional view similar to FIG. 11 showing a prior art information clip secured to the new clip holder in accordance with the invention.

DETAILED DESCRIPTION OF THE PREFERRED EMBODIMENT

Figure 5:
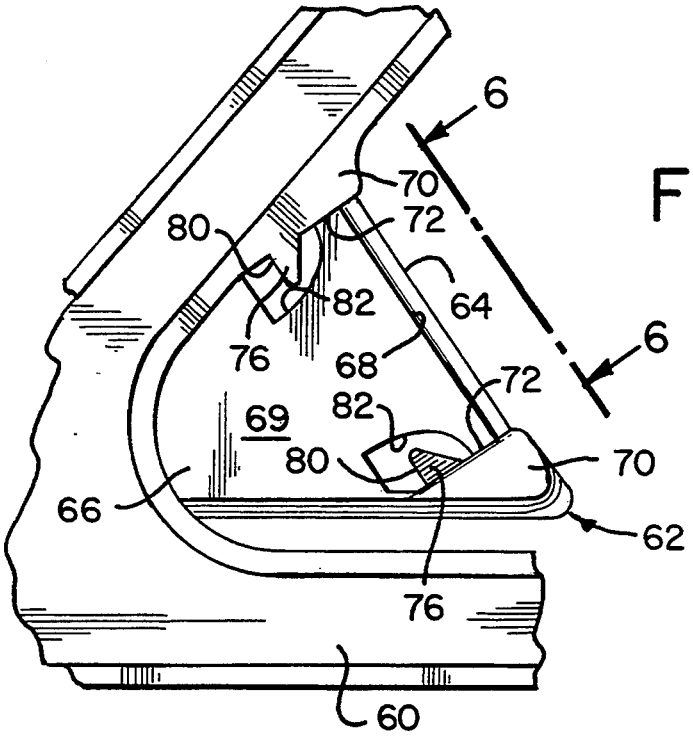
FIG. 5 is a partial plan view of the garment hanger of FIG. 4 showing details of the clip holder.

The present invention comprises two interactive parts; a new garment hanger with a new clip holder and a new mating information clip. The information clip, in accordance with the invention, is designed to be easily positioned and locked onto the clip holder to provide a garment hanger which is not only child-proof (i.e., where a child could not remove the information clip once it was secured) but also preventing intentional manual removal of the clip.

However, both the present information clip and the present clip holder are versatile. The information clip of the invention may also be used with the prior art clip holder 30 of FIG. 2, and also the present clip holder is shaped to receive prior art information clips 10 (as will be evident from FIGS. 10–12). Because of the prior art limitations described above, if a prior art clip holder is used in combination with the clip of the present invention, accidental or intentional separation between the clip and the clip holder will only be discouraged and not prevented.

In accordance with one embodiment of the invention, and referring to FIG. 3, an information clip 40 has a front surface 42, two opposing side walls 44, inner locking projections 46, an insertion channel 48, and outer locking hooks 50. In the relaxed state of clip 40, its projections 46 are desirably separated by a distance no greater than the thickness of clip holder web 66, so as to enhance the engagement of the projections 46 with the shoulders of ridge 68, as described below. The information clip 40 shown in FIG. 3 is similar in some regards to the prior art information clip shown in FIGS. 1–2, except that the present information clip 40 includes inner locking projections 46 having contact surfaces 52 which are generally parallel to the front surface 42, and the present information clip 40 includes outer locking hooks 50 (having a hook-like cross-sectional shape) each disposed along the lower edge of a side wall 44 and including engagement surfaces 54 that are directed outwardly from each respective side wall 44.

The present information clip 40, like the prior art clip 10, may be manufactured by a conventional extrusion process using an appropriate plastic such as PVC or nylon. The present information clip 40 is preferably made to have a natural resiliency so that the side walls 44 may be flexed, or otherwise deformed, but will naturally return to a relaxed position. The information clips 40 will thus have a "memory", and will (unless unduly stressed) be spring biased back to its relaxed position.

Referring to FIG. 4–7 and 10, a portion of a garment hanger 60 forming a clip holder 62 in accordance with the present invention is illustrated. The clip holder 62 is formed with a central web 66 having an exposed edge 64. A securing ridge 68 is formed along the exposed edge 64 and has a cross-sectional shape with a shoulder on its inner edge adapted to selectively engage with an information clip 40 as described above (or a prior art information clip 10) when the clip is mounted on the dip holder 62.

A receiving area 69 of the clip holder 62 for receiving the information clip 40 is defined by the exposed edge 64 and side bosses 70. Each side boss 70 is preferably formed integrally with the entire garment hanger 60 and includes an inwardly directed side wall surface 72 which faces towards and is parallel to the other opposite boss 70. The central web 66 and the securing ridge 68 are formed generally perpendicular to and between the inwardly directed surfaces 72 of the two bosses 70. The thickness of each boss 70, as measured perpendicular to the central web 66, is preferably substantially equal to the width of the front surface of the information clip 40 (represented by numeral 74 in FIG. 3).

Referring to FIGS. 4–7, projecting from and preferably formed integral with the inwardly directed surfaces 72 of each boss 70 is an engagement element in the form of a tab 76. Each of the engagement tabs 76 is positioned and shaped to first easily accept, to guide, and then engage with a respective outer locking hook 50 of the information clip 40 as the information clip 40 is advanced onto the tab holder 62 towards its fully mounted position.

Figure 6:
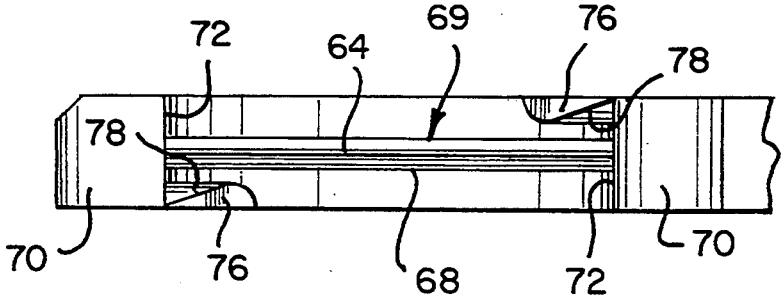
FIG. 6 is a front view of the clip holder of FIG. 4 viewed along the line 6—6 of FIG. 5.
Figure 7:
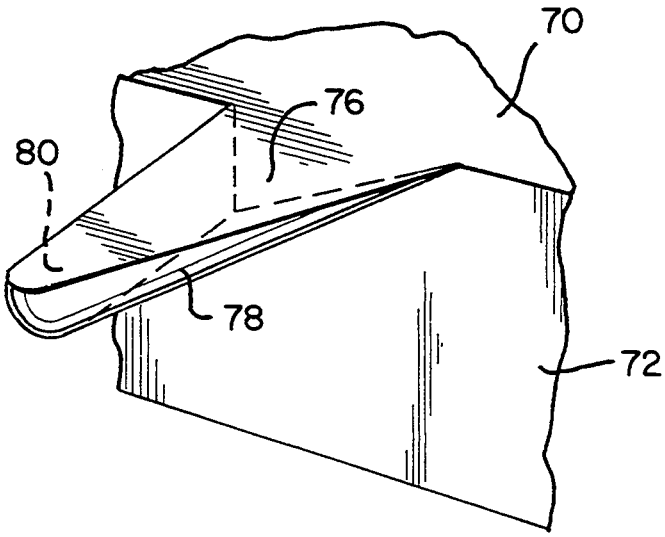
FIG. 7 is an enlarged view of a portion of the clip holder of FIG. 6 showing details of a engagement tab.

In this preferred embodiment, only two engagement tabs 76 are used for opposing-side, opposing-end engagement with a mounted information tab 40. Each engagement tab 76 is shaped to easily accept and guide a respective side wall 44 of the information clip 40, as the clip is advanced towards its fully mounted position. This is accomplished by providing a ramp 78 along the forward (towards the exposed edge 64) side of each engagement tab 76 which is directed outwardly away from the central web 66 towards the exposed edge 64, as shown in FIGS. 6–7. Each engagement tab 76 further includes a rear engagement surface 80 which preferably lies in a plane which is perpendicular to both the adjacent inwardly directed surface 72 of the boss 70 and the central web 66. The forward-facing ramp 78 is shaped rounded to provide a smooth transition to the rear engagement surface 80 or may be a planar slanted surface.

As mentioned above, only two diagonally opposing engagement tabs are used with the preferred tab holder 62. Applicant has determined that due to the relatively short length of the information clip 40 (or the prior art clips 10), it is only necessary to secure or hold-down a small portion of each side wall 44 (at either end) of the information clip 40 to ensure that the information clip 40 is effectively irremovable. In this preferred embodiment, the engagement tabs 76 function to directly hold the information clip 40 to the tab holder 62, as well as indirectly. Not only do the tabs 76 prevent outward movement of the clip by engaging the hook extensions 50 of the clip, but by preventing the separation of the side walls 44 of the clip 40 by the tabs 76, the inner locking projections 46 of the clip are caused to remain engaged with the securing ridge 68 of the tab holder 62 so that the information clip 40 will not be removable from the garment hanger 60. Therefore, the information clip 40 is directly secured to the garment hanger 60 by the strong engagement between the inner locking projections 46 and the securing ridge 68. Applicant has determined that only a slight "hold-down" strength is required to prevent the side walls 44 of the information clip 40 from being separated. The hook-like engagement between the rear engagement surface 80 and the outer locking hooks 50 provides further removal prevention of the information clip 40.

As shown in FIGS. 4 and 5, an opening 82 is provided in the central web 66 adjacent each engagement tab 76. The-purpose of each opening 82 is to provide plastic injection molding access to the underside of each engagement tab 76 which would otherwise be "hidden" or "shadowed" by the central web 66. As is known in the field of injection molding, it is beneficial to simplify the article to be molded to avoid undercuts or shadowing so that the molding process can be as inexpensive and as fast as possible. If the openings 82 where not provided, to manufacture the engagement tabs 76 the resulting mold would have to include a cramming feature which slows production down and introduces undesirable complexity. With the openings 82 present, the entire garment hanger with the clip holder 62 shown in FIGS. 4–7 can be made using a simple single plane plastic injection mold.

Referring to FIGS. 8 and **9*a*–9*c*, the operation of securing an information clip 40 to a clip holder 62 in accordance with the invention is shown. In each of the FIGS. 9*a*–9*c*, a partial cross-sectional view of the present clip holder 62 is represented. The fully mounted clip 40 shown in FIG. 9*c* is a cross-sectional view of the clip holder 62 of FIG. 8, taken along the line 9*c*—9*c*. For assembly an information clip 40 is first properly oriented and pushed against the exposed edge 64 of the clip holder 62 so that the central web 66, the exposed edge 64 and the securing ridge or 68 of the clip holder all enter within the insertion channel 48 of the information clip 40. The outer surface of the securing ridge 68 is provided to facilitate this insertion. In the preferred embodiment of this invention, the depth 84 of the securing ridge 68 is less than or equal to the distance 86 between the contact surfaces 52 and an inner surface 88 within the insertion channel 48. Further, the distance 90 between the rear engagement surface 80 and the rearmost portion of the securing ridge 68 of the clip holder 62 is less than or substantially equal to the distance 92 between the contact surface 52 and the outer locking hooks 50 of the information clip 40. The depth 94 of the engagement tabs 76 is preferably sufficiently shallow to allow easy travel of an outer locking hook 50 of an advancing information clip 40 between the central web 66 and the engagement tab 76**.

Referring now to FIG. **9*b*, as the information clip 40 is further advanced on the clip holder 62, each outer locking hook 50 is directed inwardly towards the central web 66, against natural spring bias of the clip 40, by the forward facing ramp 78 of each respective engagement tab 76 until the status shown in FIG. 9 is attained. Simultaneously, the inner locking projections 46 contact the securing ridge 68 which tends to force the side walls 44 apart at the location of the contact surfaces 52. The result is that each respective side wall 44 of an advancing information clip 40 is being forced outward adjacent its middle and simultaneously drawn inward along its lower edge. The degree of this side wall contortion is controlled by properly dimensioning the location, size and shape of the engagement tabs 76, the inner locking projections 46, the outer locking hooks 50 and the securing ridge 68. With proper dimensioning, the information clip 40 will require little force to fully mount to the clip holder 62**, but will require a great force (comparable to tearing the material) to remove.

Eventually, as shown in FIG. **9*c*, the outer locking hooks 50 engage with the engagement tabs 76, preferably at about the same time that the inner locking projections 46 "snap" into locking engagement about the securing ridge 68. When the information clip 40 reaches its fully mounted position, as shown in FIG. 9*c*, the side walls 44 are preferably allowed to displace back to their relaxed positions. It is also contemplated that the side walls may remain forced slightly inwardly towards the central web 66 so that the natural spring bias inherent in the information clip 40 retains each outer locking hook 50 in tight engagement with the engagement tabs 76**.

The engagement tabs 76 shown and described thus far represent a preferred embodiment taking into account the desirable simplified single mold without cramming. The engagement tabs 76 may take any shape, including extending completely across the receiving area 69, connecting the bosses 70 together. The engagement tabs 76 do not have to include the rear engagement surface 80. Instead, a second rear ramp (not shown) may be provided on each engagement tab 76 which contacts and holds down a respective side wall 44 of the information clip 40, yet does not strongly engage the outer locking hooks 50. In this case the inward pressure exerted on the edges 50 of the sidewalls by the tab ramps serves to retain the projections 46 in engagement with the shoulders 68, permitting the information clip 40 to be more easily forced off the clip holder 62 when using this type of engagement tab 76. In a similar contemplated embodiment (not shown) where the information clip 40 may be removed with some difficulty (by an adult)

includes a securing ridge 68 that has portions cut away at opposite ends of ridge 68 so that the mounted information clip 40 could be twisted from its engagement of both the engagement tabs 80 and the securing ridge 68. In this embodiment the securing ridge 68 includes non-engaging portions at either end of the exposed edge 64 and on the side opposite the side where the adjacent engagement tab 76 resides.

Referring now to FIGS. 10–12, the garment hanger 60, in accordance with the preferred embodiment of the invention, as described above and as shown in FIGS. 4 to 7, is shown accepting a prior art clip 10, like the one shown in FIGS. 1–2. This engagement will lock the prior art information clip to the garment clip holder, but with somewhat less strength than when using the information clip of the present invention. Like the above-described preferred embodiment, at least one (and preferably both) side walls 14, 16 of the prior art information clip 10 are physically prevented from being drawn apart by tabs 76, once the clip is engaged with the securing ridge 68, so that the prior art information clip 10 cannot be readily removed from the clip holder 62.

FIG. 11 shows a clip holder 62, in accordance with the invention, adjacent to and in a position about to receive a prior art information clip 10 (i.e., a clip not including the outer locking hooks 50, as in the present preferred information clip 40, described above). FIG. 12 shows the clip holder 62, in accordance with the invention, having a prior art clip 10 mounted thereon. The forward facing ramp 78 of each engagement tab 76 forces a respective side wall 14 or 16 inwardly towards the central web 66, so that the locking fingers 18, 20 maintain a locking engagement with the securing ridge 68, and the prior art clip 10 becomes irremovable from the present garment hanger 60.

Figure 13:
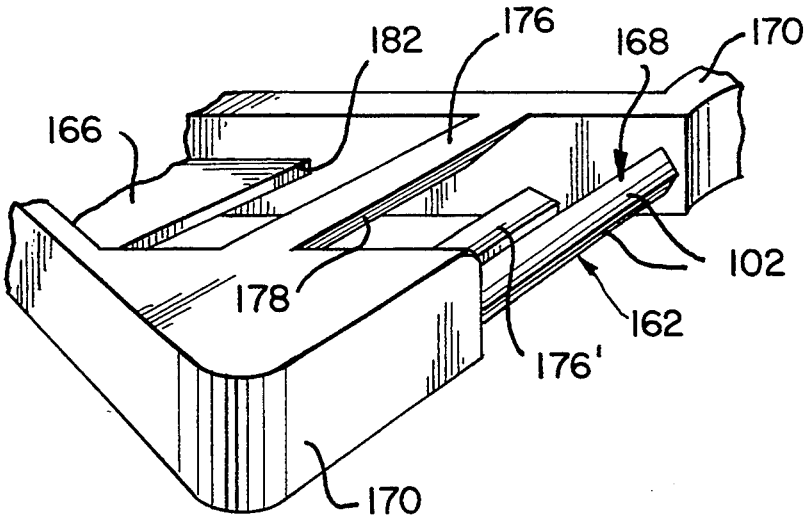
FIG. 13 is an isometric view of the clip holder portion of a garment hanger incorporating a modified form of the present invention.
Figure 14:
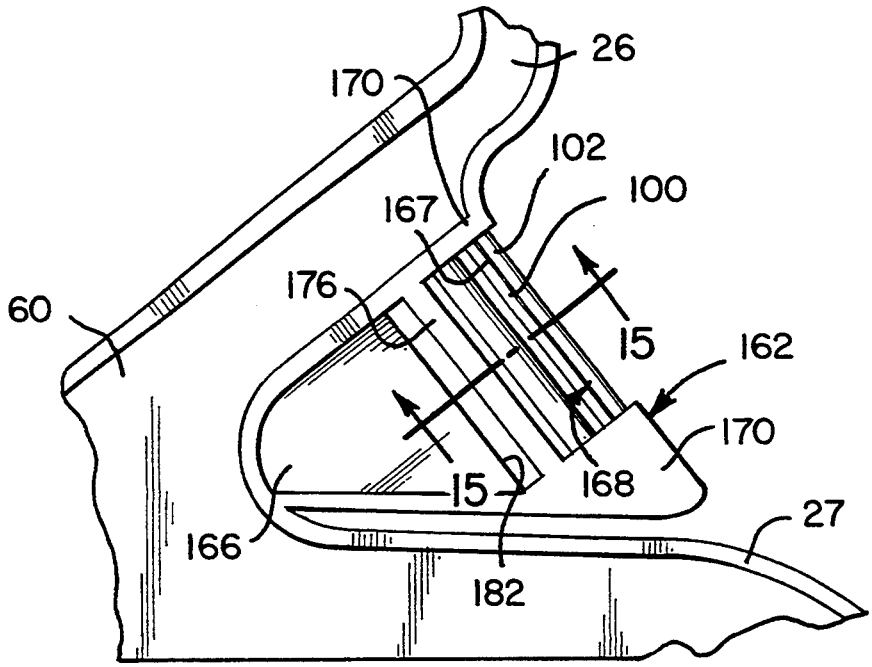
FIG. 14 is a plan view of the hanger clip holder of FIG. 13.
Figure 15:
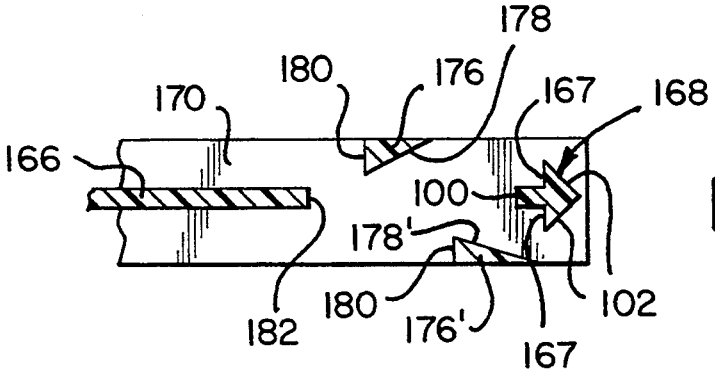
FIG. 15 is a cross-sectional view of the clip holder of FIG. 14 viewed along line 15—15 therein.

While extension tabs 76, 76' may extend a relatively short distance from one boss 70 toward the other, in order to afford a greater engagement region for the clip when installed, and for greater strength, the arrangement shown in FIGS. 13–15 may be used, having extension elements extending across the entire distance between the bosses 70.

As seen in FIGS. 13 and 14, the web 166 of clip holder 162 is provided with an opening 182 between the inner portion of web 166 and a cross-piece 100 which extends between the bosses 70 and has the securing ridge 168 at its outside edge. Ridge 168 is here shown as having slanted flat faces 102, but may be made with a suitably rounded edge as in the case of FIG. 9*b*. As before, securing ridge 168 has a shoulder 167 on each side of web 166 for engaging a respective inner locking projection 46 of the clip.

From one view point the opening 182 is an enlargement of and connects the openings 82 shown in FIG. 5. Similarly, the engagement tab 76 of FIG. 5 is in FIG. 13 in effect extended across the entire length of the web 66 (i.e., distance between bosses 70) to form an extended engagement element in the form of a cross-piece 176 having a sloped surface or ramp 178 for guiding the respective side wall of the clip toward the surface of web 166. The second engagement tab 76' is similarly extended across the entire width of the opening 182 as an engagement element in the form of a cross-piece 176'. Cross-piece 176' may be directly beneath cross-piece 176, if desired, but preferably it is offset so that the two cross-pieces 176 and 176' have differing distances from the exposed edge 164 of the clip holder 62, and do not shadow one another, to facilitate injection molding without requiring special cramming.

The cross-piece engagement elements 176 and 176' have flat interior surfaces 180 which engage the locking hooks 50 of the information clip in the manner illustrated in FIG. 9*c*. Thus, this form of clip holder of FIGS. 13–15 functions with the clip of the present invention or with conventional clips in the same manner as described above with respect to FIGS. 1–12.

Although the slanted cramming ramps 178 and 178' are shown as extending completely across the opening 182, it will be understood that they may be provided for only part of the length of the cross-pieces 176 and 176', and may extend across respectively separate portions of the width of opening 182.

As in the case of the clip holder of FIGS. 3–12, the hooks 50 engaging the flat surfaces 80 reinforce the retention effect of projections 46 engaging the shoulders 67 or 167. As will be seen from FIG. 9*c*, an effort to release the clip by squeezing together the outer hook members 50 to clear the shoulders 80 of the projections 76 or 176 only serves to engage the inner projections 46 more strongly against the shoulders of the securing ridge 68 or 168. Thus, the present invention provides a strong locking of clip to clip holder.

Thus, according to the present invention, either a conventional information clip (as in FIG. 1) or a clip according to the invention (as in FIG. 3) is securely retained on the clip holder of the invention, by providing means (e.g. tabs 76, 76' or cross-pieces 176, 176') which prevent the legs of the clip from separating, and thereby keep the ridges such as 46 of the clip engaged with the shoulder of ridge 68 or 168 of the clip holder, thus preventing removal of the clip from the clip holder.

In addition, the clip is made additionally non-removable by providing the hook-like projection 50 on the clip legs which engage the surface 80 of the tabs 76, 76' or elements 176, 176', to present movement of the clip off the clip holder.

Figure 16:
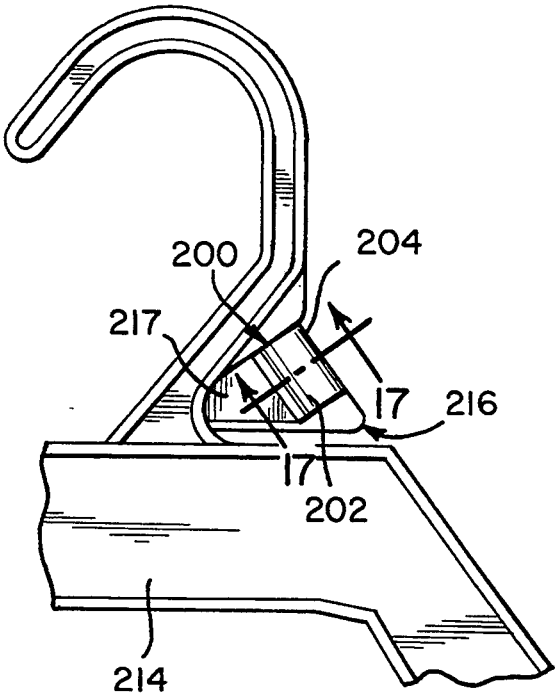
FIG. 16 is a partial plan view of a garment hanger having a clip holder and a clip in a locked position, in accordance with another embodiment of the invention.
Figure 17:
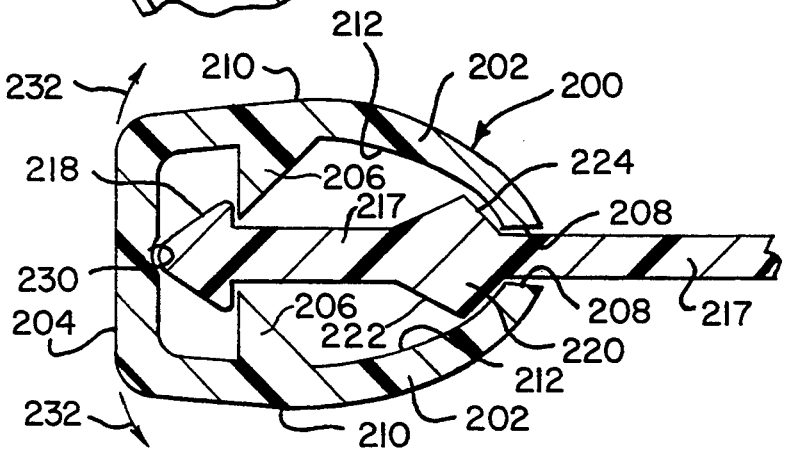
FIG. 17 is a partial cross-sectional view of a clip holder and a clip in the locked position, in accordance with the invention, taken along lines 17—17 of FIG. 16.

Referring to FIGS. 16–17, another embodiment of an information clip 200 is shown. The new clip 200 and a new holder is shown in cross-section, taken along the lines 17—17 of FIG. 16. The new clip 200 includes two side walls 202, a front face 204 and inwardly directed projections 206. The side walls 202 each include a leading edge 208, an outer surface 210 and an inner surface 212.

A hanger 214 shown in FIG. 16, like the previously described embodiments (such as FIG. 10) includes a clip holder 216 formed on a central web 217. The clip holder 216 is shown in cross section in FIG. 17. The clip holder 216 includes a front locking edge 218. The cross-sectional shape of the front locking ridge 218 is preferably a truncated triangular shape, as shown in FIG. 17. The clip holder 216 also includes a rear locking ridge 220 which is located inward from the front locking ridge 218. The two side walls 202 of the clip 200 are shaped to embrace the rear locking ridge 220. The cross-sectional shape of the rear locking ridge 220 is preferably somewhat diamond shaped, as shown in FIG. 17, however, a rounded diamond shape and a circular shape (among other shapes) have been found to work also. The rear locking ridge 220 includes a forward side 222 and a rear side 224. The forward side 222 is shaped to function as a receiving ramp for allowing the loading edges 208 of the clip 200 to easily slide into the locked position on the clip holder 216, as described in greater detail below.

The rear side 224 of the rear locking ridge 200 is preferably slanted away from and rear of the rear locking ridge 220. The cross-sectional shape of the rear side 224 preferably matches the shape of the side walls 202, as discussed below. The purpose of the rear side 224 of the rear locking ridge 220 is to help maintain engagement between the side walls 202 of the clip 200 and the clip holder 216. The matching shapes between the rear side 224 of the rear locking ridge 220 and the side walls 202 discourages the lifting of either leading edge 208 of the clip 200 from the rear side 224 by supporting the side walls 202 of the clip 200. This "close contact" of the side walls 202 and the rear side 224 prevents any inward bending (towards the front locking edge 218) of the side walls 202 and thereby maintains engagement between the clip holder 216 and the clip 200.

The side walls 202 of the clip 200 of this embodiment, as shown in FIG. 17, are preferably curved towards each other, at their leading edges 208. The clip 200 is sized and shaped to allow the curved side walls 202 to just reach beyond the rear side 224 of the rear locking ridge 220 when the clip 200 is pushed onto the clip holder 216, as shown in FIG. 17, and reaches its locked position. When the clip 200 is in its locked position on the lip holder 216, the inwardly directed projections 206 engage with the front locking ridge 218 and lock the clip onto the clip holder 216.

When the clip 200 reaches its fully locked position, as shown in FIG. 17, the leading edges 208 preferably close together under the spring bias of the clip itself and contact flush with the central web 217. The leading edges 208 may also include a flat or beveled edge (to lie flush against the central web 217) to further discourage the lifting of the side walls 202 and the removal of the clip 200.

Figure 18:
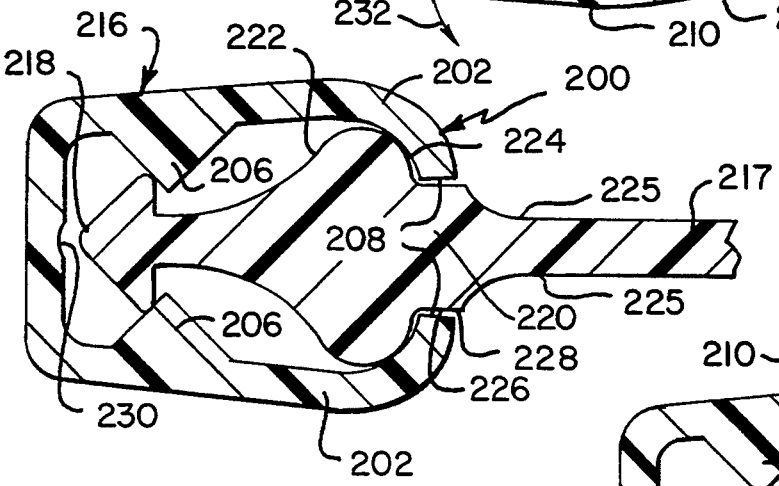
FIG. 18 is a cross-sectional view of a clip and clip holder in accordance with another embodiment of the invention, similar in view as the sectional view of FIG. 17.
Figure 19:
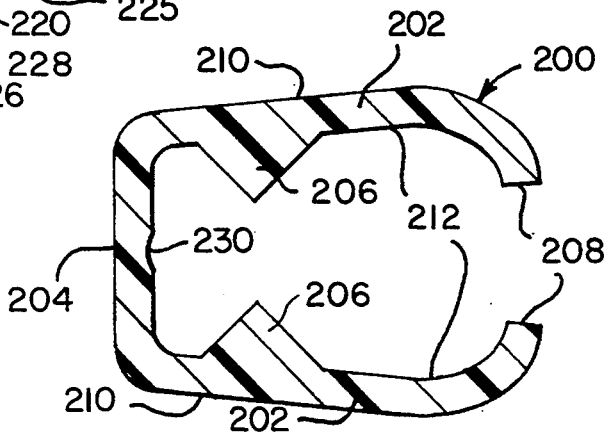
FIG. 19 is a side view of the information clip of FIG. 18 shown without the clip holder.

In accordance with another embodiment of the invention, and referring to FIGS. 18 and 19, the front locking ridge 218 is made thinner than the rear locking ridge 220 (the thickness of either locking ridge being measured along an axis perpendicular to the central web 217). By making the front locking ridge 218 thinner than the rear locking ridge 220, the clips 200 may be more easily pushed onto the clip holder 216. The clip 200 shown in FIG. 19 is made with its side walls 202 spread further apart. The distance between the leading edges 208 of the side walls 202 is preferably greater than or close to the thickness of the front locking ridge 218 so that the clip 200 may be easily pushed onto the clip holder 216 past the first front locking ridge 218. At this point the clip 200 may easily be forced into the locked position by pushing the leading edges 208 up the forward side 222 and over the wider rear locking ridge 220. Along the rear side 224 of the rear locking ridge 220 may be provided a plateau 226, positioned along the rear side to receive the leading edges 208 may be provided a plateau 226, positioned along the rear side to receive the leading edges 208 of the clip 200 when the clip is pushed into its fully locked position, as shown in FIG. 17. The width of the plateau 226 (measured along an axis parallel to the central web 217) is preferably less than the thickness of the leading edges 208 of the side walls 202 so that a small portion 228 of the plateau 226 remains uncovered by the leading edges 208 when the clip 200 is in its locked position. Although when the clip is in its locked position its leading edges are technically accessible to a person's fingernail and therefore may be grasped and pried apart, it has been discovered by the applicant that it is very difficult for a person to acquire his fingernail beneath the leading edge 208 of a locked clip 200. This is because as the fingernail slides along the central web 217, in a forward direction, and rides up the rear side 224 to the plateau 226, the fingernail has a tendency to "Jump" over the otherwise accessible leading edge and continue along the outer surface of the side wall 202 of the clip 200, failing to engage the leading edge 208. The harder the person slides his fingernail across the web 217, the more pronounced the "Jump" and the more difficult the clip becomes to remove.

It is noted that the inwardly directed projections 206 of the clip 200 are preferably non-resilient and do not themselves flex during the clip insertion process. As the clip 200 is pushed onto the clip holder 216, the larger dimensions of the locking ridges (218 and 220) will force the inwardly directed projections apart. However, the inward directed projections 206 move apart with their respective side wall 202. The clip 200 in accordance with this embodiment of the invention may also include a weakening point along the forward face 204 of the clip 200 to function as a live hinge and encourage the side walls 202 to flex apart. This live hinge may be created by an actual longitudinal groove 230 or by the relative thickness between the front face 204 and the side walls 202 of the clip 200, or by other known methods.

It is also contemplated that the inwardly directed projections be sized and shaped to prevent any twisting movement (in the direction of arrows 232 in FIG. 18) by the clip 200 when in its locked position. It is this twisting movement which allows the leading edge of the prior art clip to be excessively separated from the prior art clip holder and thereby easily grasped and removed.

It will be apparent that minor modifications may be made to the illustrative embodiments described above, by persons of ordinary skill. Therefore, the present invention is to be deemed defined solely by the appended claims.

I claim:

1. A garment hanger adapted to have an information clip mounted thereon, wherein said information clip has side walls defining an internal channel, and an internal projection in said channel, said hanger comprising a body having a hook member joined to said body at one end thereof, and a clip holder, said clip holder including means including a first region having an open edge with a securing ridge adjacent thereto, adapted to engage said clip projection upon assembly of said clip with said holder said ridge, to inhibit manual removal of said information clip from said clip holder, said clip holder including means including an engagement element for preventing outward movement of a clip side wall after said clip is mounted on said clip holder, to prevent disengagement of said projection from said ridge by separating said clip side walls, so as to prevent manual removal of said information clip from said clip holder.

2. A garment hanger as in claim 1, wherein said engagement element has means including a cramming surface on said element guiding said clip side wall toward said clip holder upon insertion of said clip.

3. A garment hanger as in claim 1, wherein said engagement element comprises a tab on said clip holder engageable with an outer surface of a clip side wall upon mounting a clip on said clip holder, to prevent outward movement of said clip side wall after said projection engages said ridge.

4. A garment hanger as in claim 3, in combination with a clip wherein said clip comprises an outwardly projecting hook-like portion at the free edge of at least one of said clip side walls, engageable with said tab to prevent retraction of said information clip from said clip holder.

5. A garment hanger as in claim 1, wherein said clip holder has a substantially planar web-like portion and said engagement element projects from at least one end of said clip holder generally parallel to and spaced from the plane of said web-like portion.

6. A garment hanger as in claim 1, wherein said clip holder comprises a web integral with said body and having a free edge with said securing ridge there along.

7. A garment hanger as in claim 6, wherein said engagement element extends from one end of said web and is spaced parallel thereto to provide access for a clip side wall between said tab and said web, whereby said tab prevents outward movement of said clip side wall after engagement of said clip with said clip holder.

8. A garment hanger as in claim 7, further comprising a second tab extending substantially parallel to said web and spaced therefrom on the side opposite said web from said first tab to accommodate the open end of a second clip side wall between said second tab and said web to prevent outward movement of said clip.

9. A garment hanger as in claim 6, said web having two ends, said engagement element being a connecting cross piece extending between said ends parallel to and spaced from said web to accommodate the end of a clip side wall therebetween.

10. A garment hanger as in claim 9, wherein said cross-piece has a cramming surface to guide the free edge of said clip side wall to a position between said cross-piece and said web.

11. A garment hanger as in claim 9 comprising a second cross-piece extending between said web ends parallel to and spaced from said web on the side of said web opposite to said first recited cross-piece to accommodate the end of the other clip side wall therebetween.

12. A garment hanger as in claim 9 wherein said cross-piece has a surface substantially perpendicular to said web, and on its side opposite to said web free edge, and said clip side wall has an extension at substantially right angles to the surface of said clip side wall and engageable with said cross-piece surface to increase the difficulty of removing said clip from said holder.

13. A garment hanger as in claim 11, wherein said cross-pieces are at respectively different distances from said web free edge, and said web has an opening or openings opposite said cross-pieces to facilitate molding of said clip holder and hanger body.

14. An information clip in combination with a garment hanger, said clip comprising a U-shaped body having a top wall and first and second side walls each joined to said top wall at one edge and having a free edge, said side walls and top wall defining a channel therebetween, said U-shaped body having a first internal projection extending inwardly from a side wall and adapted to engage a ridge on a clip holder, at least one of said side walls having at its free edge an outwardly projecting hook-like portion said garment holder having a clip holder portion with a an engagement element engaging said hook-like portion to prevent removal of said clip from said clip holder.

15. A clip as in claim 14, comprising a second internal projection extending inwardly from a second clip side wall, said first and second projections being adapted to engage said ridge to retain said clip to said clip holder.

16. A garment hanger in combination with a U-shaped information clip having a closed end and first and second side walls with free ends, each side wall having an inwardly extending projection adjacent to but spaced from said closed end, said hanger comprising a body and a clip holder integral with said body, said clip holder having an enlarged region adapted to engage said inwardly extending clip side wall projections to inhibit removal of said clip from said clip holder, said side wall projections being resiliently retained in engagement with said clip holder enlarged region, said clip holder having means cooperating with said clip side walls to prevent separation of said side walls when said clip is mounted on said clip holder to retain said projections in engagement with said clip holder enlarged region.

17. A combination as in claim 16, each of said side walls also having an outwardly extending projection adjacent its free end, said clip holder structure engaging said outwardly extending projections to additionally prevent removal of said clip from said clip holder.

18. A combination as in claim 16, said clip holder having a central web between said clip side walls when engaged, said web having a free edge with said enlarged region at said free edge, said clip holder structure having elements spaced above and below said web to engage each said sidewall between said web and a respective element, to prevent separation of said side walls sufficient to disengage said clip inwardly extended projections from said clip holder.

* * * * *